US010023985B2

(12) United States Patent
Kwon et al.

(10) Patent No.: US 10,023,985 B2
(45) Date of Patent: Jul. 17, 2018

(54) METHOD OF CONTROLLING A WASHING MACHINE

(71) Applicant: LG ELECTRONICS INC., Seoul (KR)

(72) Inventors: Sunku Kwon, Seoul (KR); Bonkwon Koo, Seoul (KR); Sunho Lee, Seoul (KR); Sanghyun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 204 days.

(21) Appl. No.: 14/735,923

(22) Filed: Jun. 10, 2015

(65) Prior Publication Data

US 2015/0354122 A1 Dec. 10, 2015

(30) Foreign Application Priority Data

Jun. 10, 2014 (KR) ..... 10-2014-0070319

(51) Int. Cl.
*D06F 29/02* (2006.01)
*D06F 33/02* (2006.01)
(Continued)

(52) U.S. Cl.
CPC ..... *D06F 29/02* (2013.01); *D06F 33/02* (2013.01); *D06F 39/003* (2013.01);
(Continued)

(58) Field of Classification Search
CPC ..... D06F 29/02; D06F 33/02; D06F 39/003; D06F 39/083; D06F 39/088;
(Continued)

(56) References Cited

U.S. PATENT DOCUMENTS 3,851,993 A * 12/1974 Foster ..... A47L 15/4225 415/200
2002/0100298 A1* 8/2002 Jeong ..... D06F 17/06 68/20
(Continued)

FOREIGN PATENT DOCUMENTS

EP 2143838 A1 * 1/2010 ..... D06F 35/006
JP 2001-070685 A 3/2001
(Continued)

*Primary Examiner* — Michael E Barr
*Assistant Examiner* — Tinsae B Ayalew
(74) *Attorney, Agent, or Firm* — Dentons US LLP

(57) ABSTRACT

Washing machine control method including an outer tub and an inner tub containing clothes rotatably disposed therein. The method includes detecting an amount of dry clothes, supplying water between the outer and inner tub such that the clothes are not wetted, discharging water from the outer tub to a circulation channel and introducing water into the inner tub through the circulation channel to wet the clothes, discharging unabsorbed water collected in the outer tub to the circulation channel such that a water level in the outer tub becomes zero while detecting a flow rate of water, and determining an amount of circulation water discharged to the circulation channel based on the flow rate detected until a water level in the outer tub becomes zero and determining properties of the clothes based on the amount of circulation water and a predetermined anticipated amount of circulation water corresponding to the amount of dry clothes detected.

16 Claims, 6 Drawing Sheets

(51) Int. Cl.
*D06F 39/00* (2006.01)
*D06F 39/08* (2006.01)

(52) U.S. Cl.
CPC ..... *D06F 39/083* (2013.01); *D06F 39/088* (2013.01); *D06F 2202/08* (2013.01); *D06F 2202/085* (2013.01); *D06F 2202/10* (2013.01); *D06F 2204/084* (2013.01); *D06F 2204/086* (2013.01)

(58) Field of Classification Search
CPC ..... D06F 2202/08; D06F 2202/085; D06F 2202/10; D06F 2204/084; D06F 2204/086
USPC ..... 8/158
See application file for complete search history.

(56) References Cited

U.S. PATENT DOCUMENTS

| | | | | |
|---|---|---|---|---|
| 2003/0024056 | A1* | 2/2003 | Kim | D06F 33/02 8/158 |
| 2008/0196172 | A1* | 8/2008 | Jeong | D06F 33/02 8/159 |
| 2011/0247145 | A1* | 10/2011 | Chanda | D06F 33/02 8/137 |
| 2013/0091635 | A1 | 4/2013 | Guzman | |

FOREIGN PATENT DOCUMENTS

| | | | |
|---|---|---|---|
| JP | 2011-245211 | A | 12/2011 |
| JP | 2014-079349 | A | 5/2014 |
| WO | 2013/031047 | A1 | 3/2013 |

* cited by examiner

METHOD OF CONTROLLING A WASHING MACHINE

CROSS-REFERENCE TO RELATED APPLICATION

This application claims priority under 35 U.S.C. § 119 to Korean Patent Application No. 10-2014-0070319, filed on Jun. 10, 2014 in the Korean Intellectual Property Office, the entire disclosure of which is incorporated herein by reference.

BACKGROUND

1. Field

The present disclosure relates to a method of controlling a washing machine.

2. Description of the Related Art

Washing machines generally refer to various apparatuses which are constructed to remove pollutants from laundry (or clothes) by chemical actions of water and detergent, physical actions of rotating an inner tub containing clothes, and the like. Such a washing machine includes an outer tub for containing water and an inner tub rotatably disposed in the outer tub to contain clothes. Some types of washing machines may further include a washing blade (e.g. pulsator). As the washing machine operates after loading the clothes into the inner tub, operations such as water supply, washing, rinsing, and dewatering are performed in accordance with a predetermined algorithm.

In operations such as washing, rinsing, and dewatering performed by a typical automatic washing machine, operation conditions are set according to an amount of loaded clothes. For example, an amount of water supply, rotational speed of the inner tub in dewatering operation (hereinafter also referred to as dewatering speed), rotating time of the inner tub during the dewatering operation (hereinafter also referred to as dewatering time), and the like are determined according to a measured amount of clothes.

Since the dewatering conditions such as dewatering speed and dewatering time are set based on an amount of clothes detected when said clothes are wet (hereinafter referred to as amount of wetted clothes), a detected amount of wetted clothes cannot serve as a barometer reflecting an actual amount of clothes excluding water absorbed in the clothes (hereinafter referred to as amount of dry clothes) in some properties of clothes (e.g., water absorption capacity). Accordingly, there is a problem in that efficient treatment of clothes cannot be achieved even though dewatering conditions are set according to an amount of wetted clothes.

For example, even though an amount of wetted clothes that is measured when summer clothing is introduced into an inner tub and an amount of wetted clothes that is measured when winter clothing is introduced into the inner tub are the same, the winter clothing should be treated at a higher dewatering speed or for a longer dewatering time than the summer clothing because the winter clothing absorbs more water than the summer clothing. However, in a conventional washing machine in which dewatering conditions are set based on an amount of wetted clothes, since both dewatering operations for the winter clothing and the summer clothing are performed in the same manner, there are problems in that the clothes cannot be optimally dewatered and power consumption efficiency is lowered.

SUMMARY

Therefore, the present disclosure has been made in view of the above problems, and it is an object to provide a method of controlling a washing machine which is capable of determining properties of clothes.

It is another object to provide a method of controlling a washing machine in which an operational pattern is determined according to detected properties of clothes.

It is a further object to provide a method of controlling a washing machine which is capable of accurately determining properties of clothes based on flow rate information.

It is yet another object to provide a method of controlling a washing machine which is capable of determining properties of clothes without discharge of water.

It is still another object to provide a method of controlling a washing machine which can determine properties of clothes at an initial stage of operation at which water supply is performed and then can optimally perform respective subsequent operations such as washing, rinsing, and dewatering according to the determined properties of clothes.

In accordance with an aspect of the present disclosure, the above and other objects can be accomplished by the provision of a method of controlling a washing machine including an outer tub and an inner tub rotatably disposed in the outer tub to contain clothes, the method including (a) detecting an amount of clothes while the clothes are dry, (b) supplying water between the outer tub and the inner tub such that the clothes are not wetted with water, (c) discharging water from the outer tub to a circulation channel and introducing water into the inner tub through the circulation channel to wet the clothes with water, (d) discharging water that is not absorbed in the clothes but collected in the outer tub to the circulation channel such that a water level in the outer tub becomes zero while detecting a flow rate of the discharged water, and (e) determining an amount of circulation water discharged to the circulation channel based on the flow rate detected in (d) until a water level in the outer tub becomes zero and determining properties of the clothes based on the amount of circulation water and a predetermined anticipated amount of circulation water corresponding to the amount of clothes detected in step (a).

The method may further includes detecting fluctuations in the water level of the outer tub during execution of step (c), wherein step (d) may be performed after the fluctuations of the water level in the outer tub are within a predetermined range.

Discharging the water in step (c) or (d) may be performed by a circulation pump provided at the circulation channel.

The flow rate in step (d) may be determined based on a rotational speed of the circulation pump.

The amount of circulation water may be determined based on the flow rate determined in step (d) and an activation time of the circulation pump until a water level in the outer tub becomes zero.

The method may further include detecting when a water level in the outer tub becomes zero based on variation of driving current of the circulation pump.

Step (c) may include spraying the water transferred through the circulation channel into the inner tub.

Step (c) may include rotating the inner tub at a rotational speed during the spraying of water into the inner tub such that the clothes adhere to an inner side wall of the inner tub.

The method may further include setting dewatering conditions based on the properties of clothes determined in step (e).

As a water absorption rate which is one of the properties of clothes determined in step (e) is lower, a maximum rotational speed for dewatering may be set to be lower.

As a water absorption rate which is one of the properties of clothes determined in step (e) is lower, a dewatering period of time may be set to be shorter.

As a water absorption rate which is one of the properties of clothes determined in step (e) is higher, a maximum rotational speed for dewatering may be set to be higher.

As a water absorption rate which is one of the properties of clothes determined in step (e) is higher, a dewatering period of time may be set to be longer.

The method may further include, after step (e), (f) discharging water from the outer tub, and (g) detecting an amount of the clothes after discharge of the water from the outer tub, wherein dewatering conditions may be set based on the amount of clothes detected in step (g) and the properties of clothes determined in step (e).

BRIEF DESCRIPTION OF THE DRAWINGS

The embodiments will be described in detail with reference to the following drawings in which like reference numerals refer to like elements wherein.

DETAILED DESCRIPTION

Advantages, features, and methods for achieving those of embodiments will become apparent upon referring to embodiments described later in detail together with attached drawings. The present invention is not limited to the embodiments disclosed hereinafter, and may be embodied in various modes. The embodiments of the present invention described hereinbelow are provided for allowing those skilled in the art to more clearly comprehend the present disclosure. The same reference numbers may refer to the same elements throughout the specification.

Figure 1:
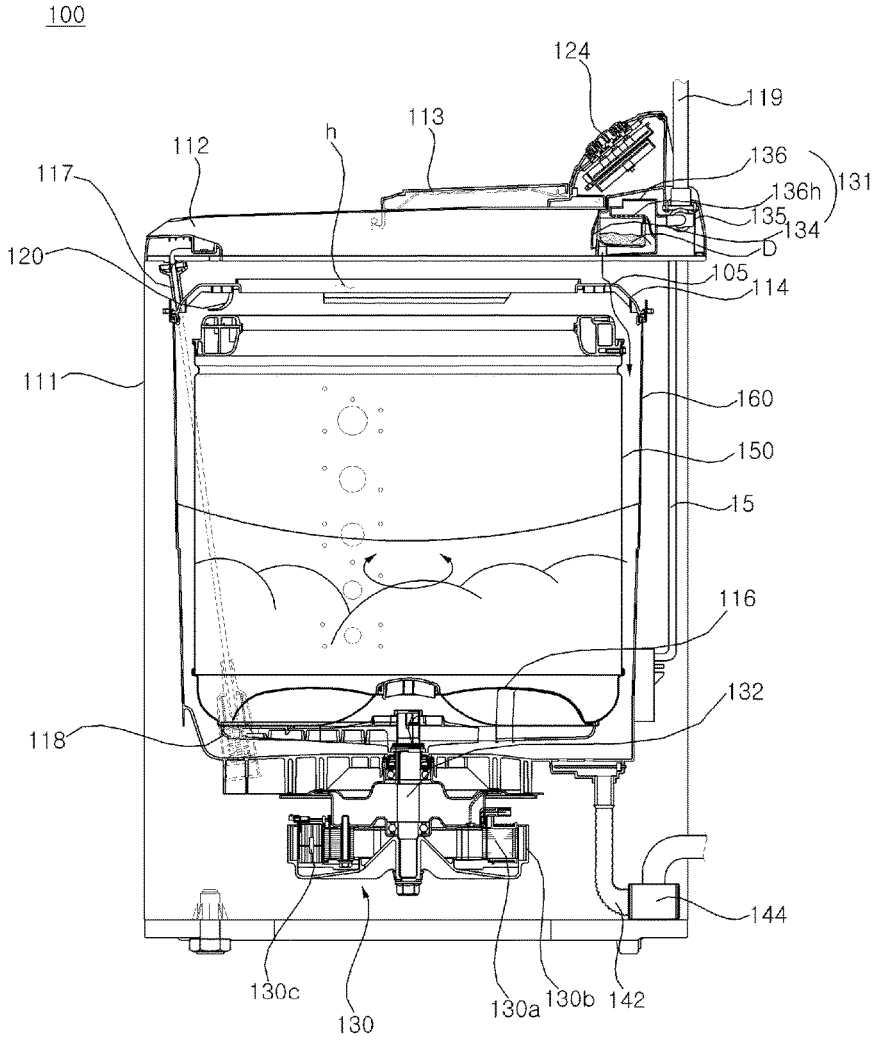
FIG. 1 is a side cross-sectional view showing a washing machine according to an embodiment of the present invention.
Figure 2:
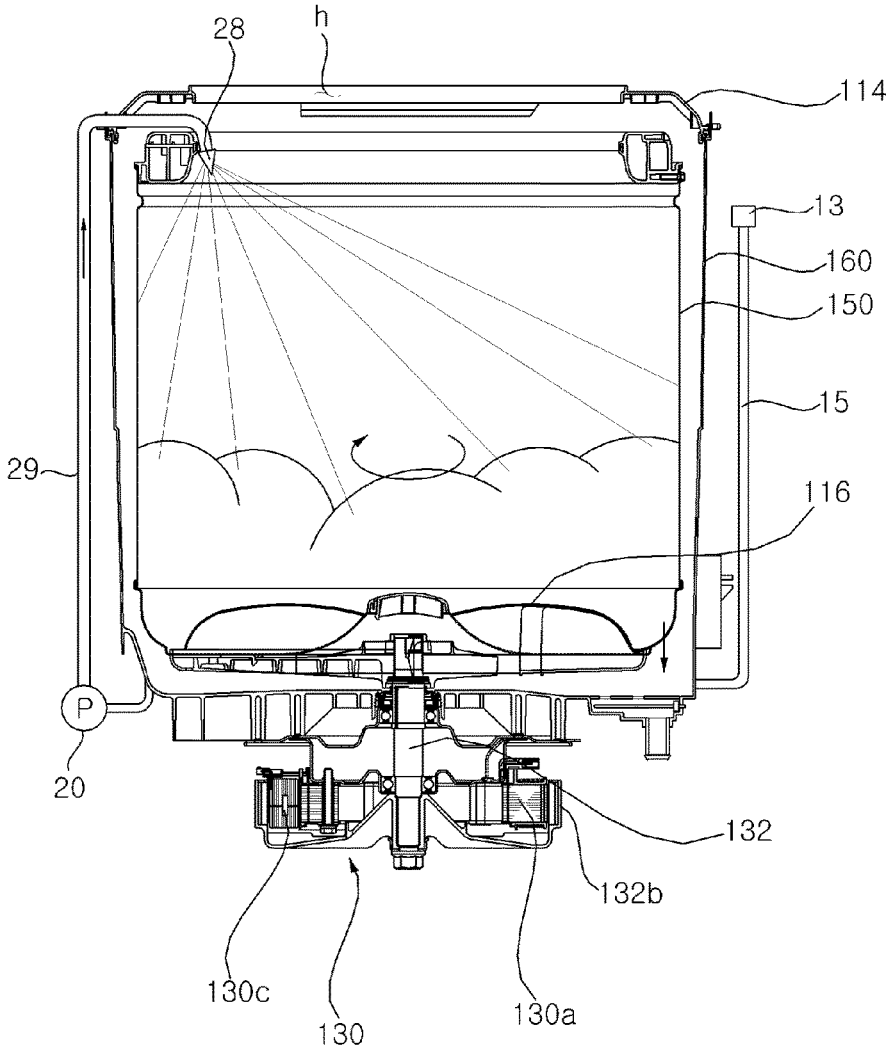
FIG. 2 is a view specifically showing substantial parts of the washing machine shown in FIG. 1.
Figure 3:
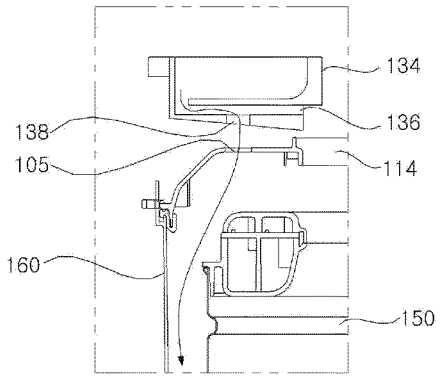
FIG. 3 is an enlarged view of a part of FIG. 1.
Figure 4:
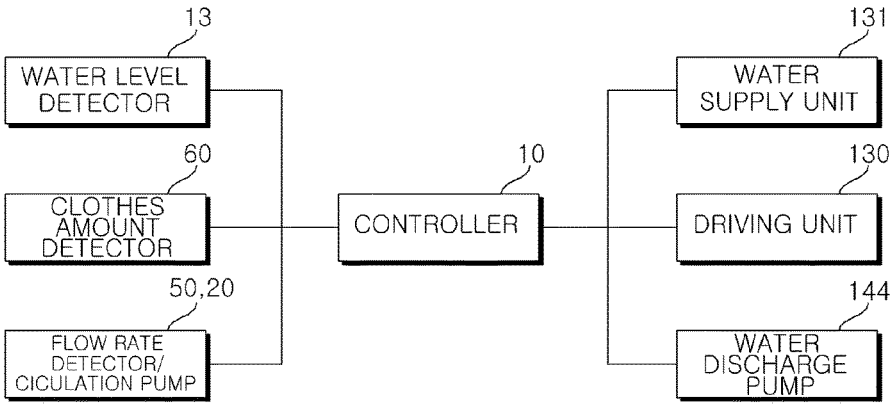
FIG. 4 is a block diagram showing control relationship between substantial parts of the washing machine according to the embodiment of the present invention.

FIG. 1 is a side cross-sectional view showing a washing machine according to an embodiment of the present invention. FIG. 2 is a view specifically showing substantial parts of the washing machine shown in FIG. 1. FIG. 3 is an enlarged view of a part of FIG. 1. FIG. 4 is a block diagram showing control relationship between substantial parts of the washing machine according to the embodiment of the present invention.

Referring to FIGS. 1 to 3, a washing machine 100 according an embodiment of the present invention includes a cabinet 111 having an open upper end, a cabinet cover 112 disposed on the open upper end of the cabinet 111 and having a laundry entrance through which laundry is put into or taken out of the cabinet 111, and a door 113 for opening and closing the laundry entrance. Cabinet cover 112 may be provided with a control panel 124 through which commands for the overall operations of the washing machine 100 are input by a user.

Cabinet 111 may be provided therein with an outer tub 160 for containing water, and an inner tub 150 rotatably disposed in the outer tub 160 to contain laundry or clothes. Inner tub 150 has a plurality of water holes (not shown) through which water may be circulated between the outer tub 160 and the inner tub 150. Outer tub 160 may be provided at an upper end thereof with an outer tub cover 114 having an open center area h to allow clothes to be put into or taken out therethrough.

Outer tub 160 is suspended in cabinet 111 by means of a support member 117. Support member 117 is connected at one end thereof to cabinet cover 112 and at the other end thereof to the outer tub 160 through a suspension 118. Vibration of the outer tub 160 caused by rotation of the inner tub 150 is mitigated by the suspension 118.

Inner tub 150 is provided at the bottom thereof with a pulsator 116, and the outer tub 160 is provided thereunder with a drive unit 130 for generating rotational force required for rotation of the pulsator 116 and/or the inner tub 150.

Drive unit 130 may include a motor having a stator 130*a* around which a coil is wound and a rotor 130*b* rotated by electromagnetic force generated between the rotor 130*b* and the coil. Furthermore, the drive unit 130 may include a driver (not shown) for controlling activation of the motor, and a Hall sensor 130*c* for detecting a position of the rotor 130*b*. A controller 10 may detect a rotational speed or position of the rotor 130*b* based on a signal output from the Hall sensor 130*c*.

A rotating shaft 132 of the drive unit 130 extends through the outer tub 160 to selectively rotate the inner tub 150 and the pulsator 116. A clutch (not shown) for transmitting rotational force of the rotating shaft 132 to the inner tub 150 and/or the pulsator 116 may be provided. By actuation of the clutch, the pulsator 116 may be rotated alone or in conjunction with the inner tub 150.

A water supply unit 131 may supply water between the outer tub 160 and the inner tub 150. Water supply unit 131 may include a water supply valve 135 for opening and closing a water supply channel 119 into which water supplied from an external water source is introduced, and a detergent box 134 and a detergent box housing 136 provided at the water supply channel 119. Detergent box housing 136 may have a distribution hole 136*h* for distributing water introduced to the water supply channel 119 to the detergent box 134.

Detergent box housing 136 may be disposed at the cabinet cover 112. Detergent box 134, which is adapted to contain detergent D, may be retractably accommodated in the detergent box housing 136.

Detergent box housing 136 may have an opening 138. In some embodiments, the outer tub cover 114 may have a water supply opening 105 through which water discharged from the water supply unit passes. Upon supply of water, water having passed through the opening 138 may be introduced between the inner tub 150 and the outer tub 160 through the water supply opening 105.

A circulation pump 20 may be provided to forcibly pump water discharged from the outer tub 160, through a circulation channel 29. Circulation channel 29 may be provided with a spray nozzle 28. In this case, upon activation of the circulation pump 20, water is sprayed into the inner tub 150 through the spray nozzle 28. A valve (not shown) may further be provided to open and close the circulation channel 29.

A water discharge pump 144 may be provided to discharge water from the outer tub 160. Water discharge pump 144 may be provided at a water discharge channel 142 communicating with the outer tub 160. Although the circulation pump 20 and the water discharge pump 144 are separately provided in this embodiment, circulation through a circulation channel and water discharge through the water discharge channel may be selectively performed through a single pump if the channels are properly configured.

Washing machine 100 may include a water level detector 13 for detecting a level of water contained in the outer tub 160. A communication tube 15 connected to the outer tub 160 may be provided, and the water level detector 13 may include a pressure sensor for measuring a pneumatic pressure exerted through the communication tube 15. Since a pressure detected by the pressure sensor varies depending on a level of water in the outer tub 160, the water level detector 13 may determine a level of water in the outer tub 160 based on a pressure detected by the pressure sensor. However, this configuration is but one embodiment, and the water level detector 13 may, of course, be configured into various configurations known in the art.

Washing machine 100 may include a flow detector 50 for detecting a flow rate of water flowing through the circulation channel 29. Flow detector 50 may include a flow meter. A controller 10 may determine an amount of water (hereinafter referred to as "amount of circulation water") transferred through the circulation channel 29, based on a flow rate measured by the flow meter. Although the flow meter may be provided separately from the circulation pump 20, the circulation pump 20 may serve as the flow meter. In this embodiment, an additional flow meter is not provided, and the controller 10 may detect a flow rate based on a rotational speed (RPM) of the circulation pump 20.

Controller 10 may determine an amount of circulation water based on the flow rate determined by a rotational speed of the circulation pump 20 as well as a period of time for which the circulation pump 20 is operated under the loaded condition during detection of the flow rate. The period of time for which the circulation pump 20 is operated under the loaded condition is a period of time required from the time of the loaded condition (condition in which the outer tub 160 is filled with water) to the time of the unloaded condition (condition in which water contained in the outer tub 160 is substantially zero by operation of the circulation pump 20).

A driving current applied to the circulation pump 20 rapidly decreases in magnitude when the circulation pump 20 is operated under the unloaded condition, compared to when operated under the loaded condition. Accordingly, the controller 10 may detect the time point when the circulation pump 20 begins to operate under the unloaded condition, based on variation of the driving current.

An amount of circulation water is proportional to a rotational speed of the circulation pump 20 and a period of time for which the circulation pump 20 is operated under the loaded condition. Since the rotational speed of the circulation pump 20 is set by the controller 10 and is known, an amount of the circulation water may be determined if only a period of time for which the circulation pump 20 is operated under the loaded condition is determined. Controller 10 drives the circulation pump 20 at a predetermined speed under the loaded condition, and detects the time point when the driving current rapidly decreases during operation of the circulation pump 20 (time point of reaching the unloaded condition), thus determining a period time for which the circulation pump 20 is operated under the loaded condition (period of time required from the start point of the operation under the loaded condition to the time point of reaching the unloaded condition).

A clothes amount detector 60 detects an amount of clothes introduced to the inner tub 150. Clothes amount detector 60, which utilizes the principle that inertia of the inner tub 150 varies depending on an amount of introduced clothes, may determine an amount of clothes based on variations of barometers (for example, variation of driving current and variation of driving speed), which is input or output from the driving unit 130, reflecting inertia of the inner tub 150. However, the clothes amount detector 60 is not limited thereto but may be constituted by various clothes amount detecting devices already known in the technical field of washing machines.

Figure 5:
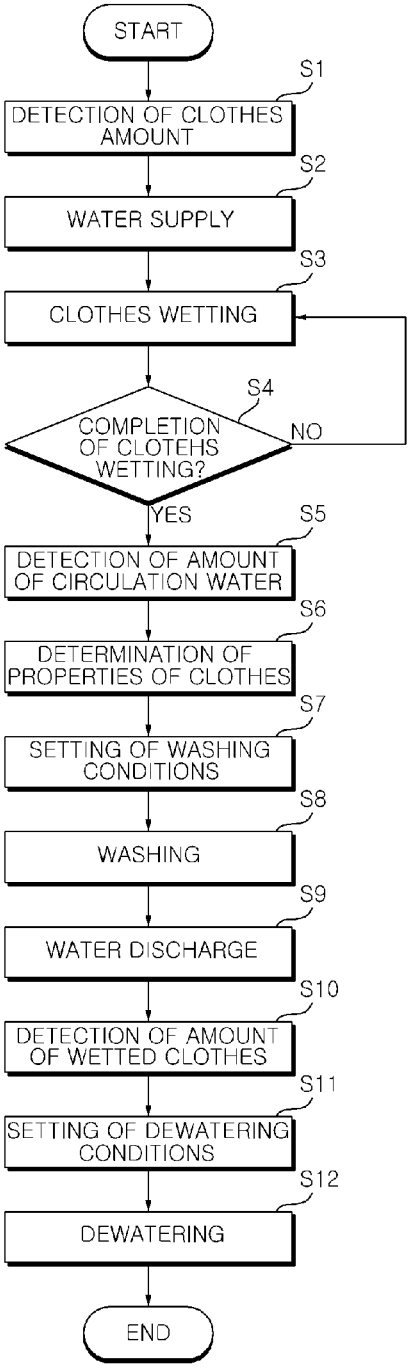
FIG. 5 is a flowchart showing a method of controlling a washing machine according to another embodiment of the present invention.
Figures 6A, 6B, 6C:
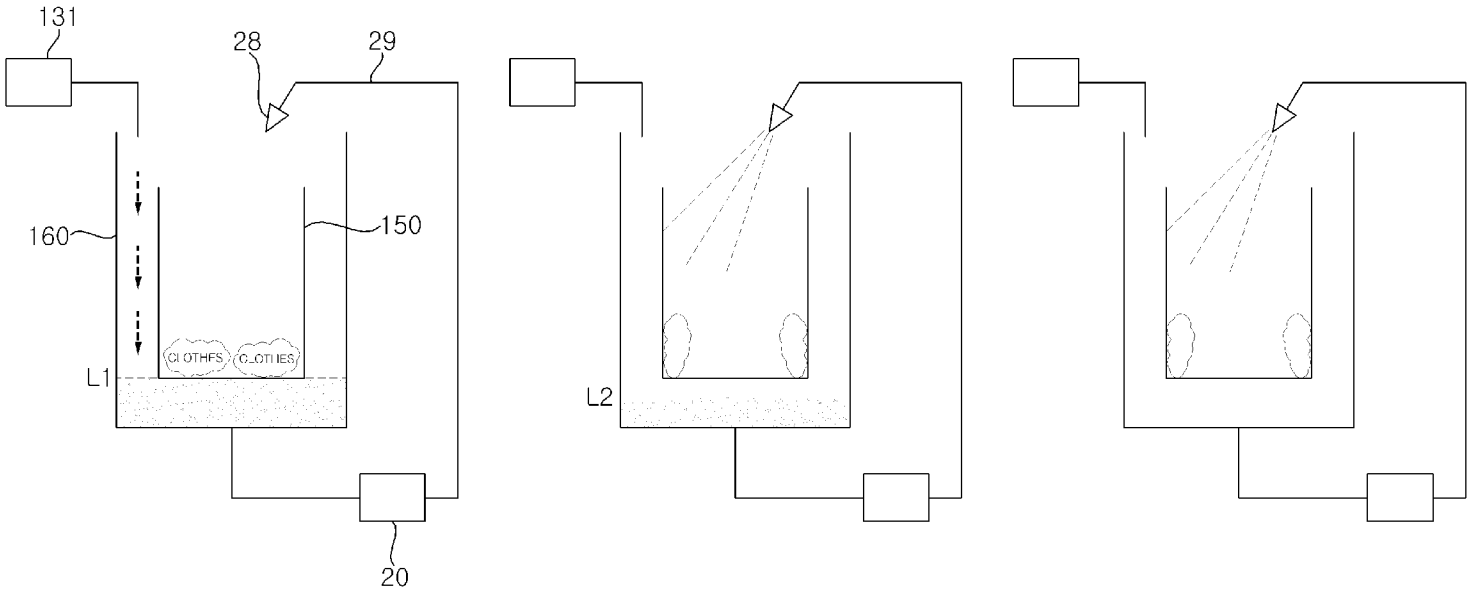
FIG. 6*a* is a schematic view showing an operation of performing water supply S2.
FIG. 6*b* is a schematic view showing an operation of performing a clothes soaking S3.
FIG. 6*c* is a schematic view showing an operation of detecting a flow rate of circulation water.
Figure 7:
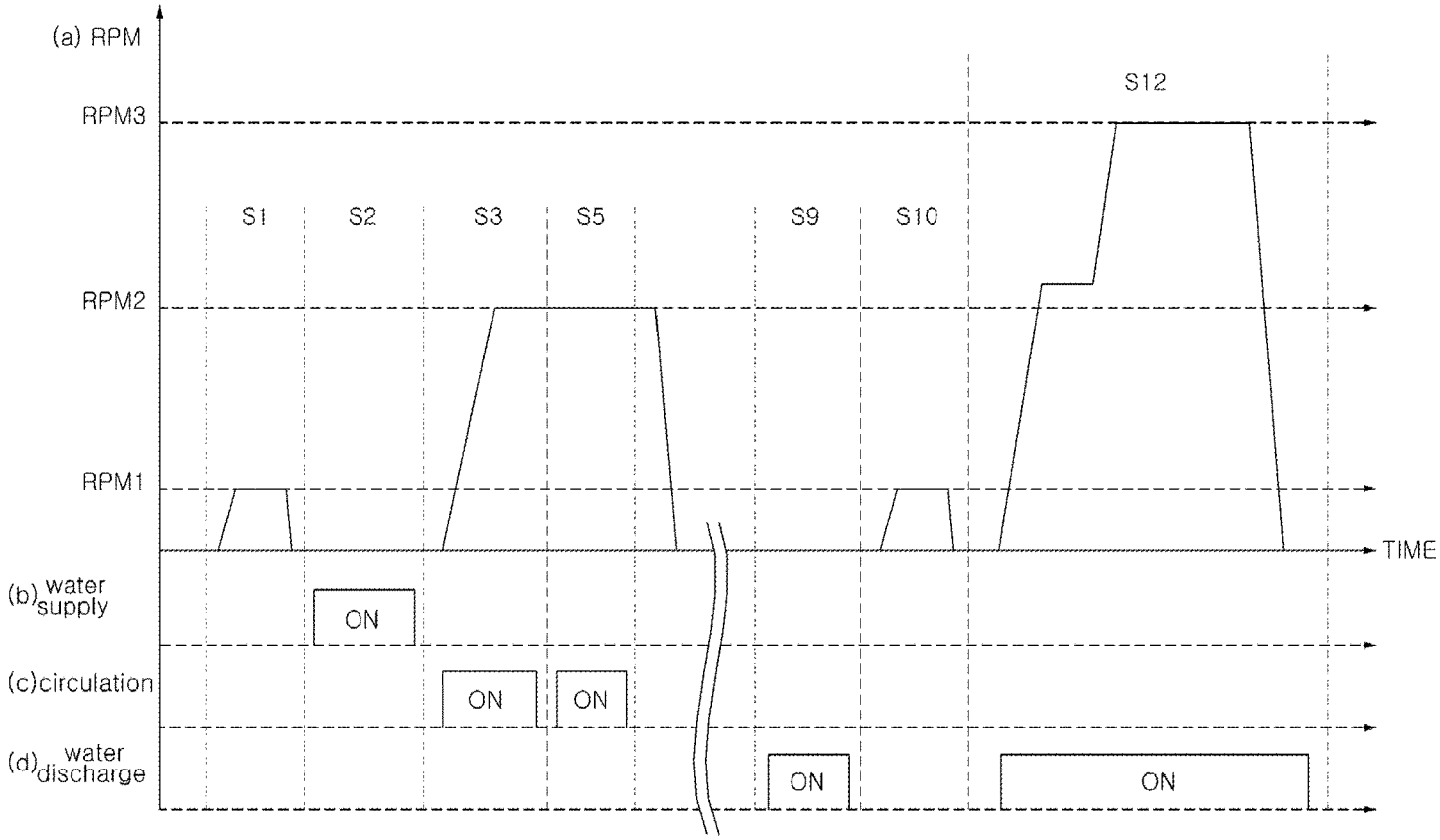
FIG. 7 is a graph showing rotational speed of the inner tub (a), water supply control (b), circulation control (c), and water discharge control (d) in respective operations of the washing machine according to an embodiment of the present invention.

FIG. 5 is a flowchart showing a method of controlling a washing machine according to another embodiment of the present invention. FIG. 6*a* schematically shows an operation of performing water supply S2, FIG. 6*b* schematically shows an operation of performing a clothes soaking S3, and FIG. 6*c* schematically shows an operation of detecting a flow rate of circulation water. FIG. 7 is a graph showing rotational speed of the inner tub (a), water supply control (b), circulation control (c) and a water discharge control (d) in respective operations of a washing machine according to an embodiment of the present invention.

Referring to FIGS. 5 to 7, the method of controlling a washing machine according to the embodiment of the present invention includes detecting an amount of clothes while the clothes are not submerged (i.e. before the laundry is soaked) (S1), supplying water between the outer tub 160 and the inner tub 150 such that the clothes are not soaked by the supplied water (S2), discharging water from the outer tub 160 to the circulation channel 29 and introducing water into the inner tub 150 through the circulation channel 29 to wet the clothes (S3), discharging water which is not absorbed in the clothes but collected in the outer tub 160, to the circulation channel 29 so as to cause a level of water contained in the outer tub 160 to be zero and detecting a flow rate of circulation water (S5), and determining an actual amount of circulation water discharged to the circulation channel 29 based on the flow rate detected in step S5 until a level of water contained in the outer tub 160 becomes zero facilitating the determination of properties of the clothes based on the actual amount of circulation water and a predetermined anticipated amount of circulation water corresponding to the amount of clothes detected in step S1 (S6).

More specifically, the clothes amount detecting step S1 is performed in the state where the clothes are not submerged. Inertia of the inner tub 150 varies depending on an amount of introduced clothes. Here, inertia of the inner tub 150 may be any one of static inertia or dynamic inertia. An amount of clothes may be determined based on a number of barometers, which are input or output from the driving unit 130, reflecting inertia of the inner tub 150. According to the embodiment, an amount of clothes is determined based on static inertia of the inner tub 150. As shown in FIG. 7, the inner tub 150 may be accelerated from rest to a speed of a first rotational speed (RPM1) and rotated at the first rotational speed (RPM1) for a predetermined period of time in the clothes amount detecting step S1. The first rotational speed (RPM1) is preferably about 30 rpm.

Since the static inertia of the inner tub 150 is exerted in a range in which the inner tub 150 is accelerated to the first rotational speed (RPM1), particularly in a predetermined range in which the inner tub 150 is accelerated from rest, a current value applied to the driving unit 130 is increased as an amount of clothes is larger. Accordingly, the controller 10 may determine an amount of clothes based on a current value applied to the driving unit 130 during acceleration of the inner tub 150 to the first rotational speed (RPM1). In a case of a BLDC motor, a q-axis current value may be considered in determination of an amount of clothes.

Additionally, upon determination of an amount of clothes, a back electromotive force of the driving unit 130 detected during rotation of the inner tub 150 at the first rotational speed (RPM1) may be considered. The back electromotive force, which is a barometer reflecting dynamic inertia of the inner tub 150, is increased as an amount of clothes is larger. Of course, in step S1, an amount of clothes may be detected by other various known technologies.

The water supply step S2 serves to supply water to the outer tub 160 such that clothes are not soaked in water. As shown in FIG. 3, water may be supplied between the inner tub 150 and the outer tub 160 through the water supply unit 131. A target water level is preferably set as high as possible so long as water does not infiltrate the inner tub 150. For example, in the water supply step S2, water may be supplied to the bottom of the inner tub 150 or the bottom of the pulsator 116. At this point, the target water level in the outer tub 160 is designated by a water supply level (L1) in FIG. 6*a*. Since the clothes are not soaked in water even after execution of the water supply step S2, the clothes amount detecting step S1 may also be performed after the water supply step S2. In this case, the water supply level (L1) is preferably lower than the bottom of the inner tub 150.

A water level in the outer tub 160 may be detected by the water level detector 13. When the water level detector 13 detects that a water level in the outer tub 160 reaches the water supply level (L1), the controller 10 may close the water supply valve 135.

In the clothes wetting step S3, water discharged from the outer tub 160 is transferred through the circulation channel 29 and then introduced into the inner tub 150 again. Hereinafter, water, which is transferred through the circulation channel 29, is referred to as circulation water. A circulation procedure in which the circulation water introduced to the inner tub 150 is collected in the outer tub 160 again and then the collected water is transferred through the circulation channel 29 again has to be consecutively carried out. In the case of circulation pump 20 capable of controlling a flow rate, a rotational speed of the circulation pump 20 is preferably controlled in a range capable of ensuring consecutiveness of the circulation procedure.

Referring to FIG. 6*b*, circulation water may be sprayed into the inner tub 150 through the spray nozzle 28 as described in the above embodiment, and the inner tub 150 may rotate so as to cause clothes in the inner tub 150 to be uniformly wetted by the sprayed water. At this point, a rotational speed (RPM2 of FIG. 7) of the inner tub 150 is preferably set above a certain speed such that clothes are rotated in the state of adhering to an inner surface of the inner tub 150 by centrifugal force. Since the minimum rotational speed at which clothes can be rotated in the state of adhering to the inner tub 150 may vary depending on an amount of the clothes, a rotational speed of the inner tub 150 in step S3 is preferably set according to an amount of clothes detected in the clothes amount detecting step S1. A spray direction of the spray 28 is preferably directed toward the inner lateral surface of the inner tub 150.

A clothes wetting completion determining step S4, which serves to determine whether clothes are sufficiently wetted, is preferably performed to determine whether clothes are wetted to the extent that the clothes cannot absorb any more water. Whether clothes are completely wetted may be determined by variation of a water level in the outer tub 160, variation of load applied to the driving unit 130 and the like. In this embodiment, the completion of clothes wetting is determined when a water level in the outer tub 160 is equal to or higher than a predetermined value and water level is fluctuated within a predetermined range. At an initial stage of the clothes wetting step S3, since water is actively absorbed in clothes and a considerable period of time is required until the circulation water sprayed into the inner tub 150 is again introduced into the outer tub 160 through the inner tub 150, a water level in the outer tub 160 is low. At this point, fluctuation of water level detected by the water level detecting unit 13 cannot accurately reflect a wetting degree of clothes. Accordingly, the controller 10 determines completion of clothes wetting, based on fluctuation of water level detected by the water level detecting unit 13, after a predetermined amount of water is collected in the outer tub 160 because clothes are sufficiently wetted to the extent that the clothes cannot absorb water any more, that is, after a water level in the outer tub 160 is equal to or higher than a predetermined value.

The controller 10 may determine that clothes wetting is completed when fluctuation of water level in the outer tub 160 is in a predetermined range. Particularly, when clothes absorb a sufficient amount of water during execution of the clothes wetting operation S3 (when fluctuation of water level in the outer tub 160 is in a predetermined range), a stabilization state in which a flow rate of water discharged to the outer tub 160 from the inner tub 150 fluctuates in a predetermined range is obtained.

FIG. 6*b* shows a state in which clothes absorbs a sufficient amount of water and a water level in the outer tub 160 is lowered to a water supply level (L2).

The step S5 serves to determine a flow rate of circulation water. A flow rate of water transferred through the circulation channel 29 is detected by the flow detector 50. As described above, the flow detector 50 may include the circulation pump 20. In this case, the controller 10 may determine a flow rate based on a rotational speed (rpm) of the circulation pump 20. In step S5, the controller 10 may determine an amount of water discharged from the outer tub 160 and then introduced to the inner tub 150 through the circulation channel 29, that is, an amount of circulation water, based on the detected flow rate and a period of time for which the circulation pump 20 is operated under the loaded condition. As described above, the controller 10 detects when driving current abruptly changes during operation of the circulation pump 20, that is, the instant when the circulation pump 20 begins to operate under the unloaded condition. As a rotational speed of the circulation pump 20 is lower, circulation water introduced to the inner tub 150 flows into the outer tub 160 to increase a water level before water contained in the outer tub 160 is completely discharged to the circulation channel 29, thus causing the circulation pump 20 to be continuously operated under the loaded condition. At this point, it is impossible to detect when the circulation pump 20 begins to operate in the unloaded state. Accordingly, in step S5, a rotational speed of the circulation pump 20 is preferably controlled to be an appropriate speed at which operation of the circulation pump 20 under the unloaded condition can be detected when a water level in the upper tub 160 becomes zero (see FIG. 6*c*) due to transfer of water through the circulation channel 29. Considering this situation, a rotational speed of the circulation pump 20 in step S5 may be set to be higher than that in operation S3.

An amount of the circulation water detected in step S5 is inversely proportional to an amount of water absorbed in clothes. Clothes have different capacities of absorbing water (herein after, referred to as "water absorption rate") depending on materials of the clothes. Even though amounts of clothes are the same, clothing having a higher water absorption rate absorbs more water. For example, if pillows are contained in the inner tub 150 and blue jeans are contained in the inner tub 150, even though amounts of the pillow and blue jeans detected in step S1 are the same, the pillow absorbs much more water because the pillow has a higher water absorption rate than the blue jeans. Therefore, properties of clothes may be determined from relationship between an amount of clothes and an amount of circulation water.

More specifically, in step S6, the controller 10 may determine properties of clothes based on the amount of clothes ($W_d$) detected in step S1, the predetermined anticipated amount of circulation water ($Q_0$) corresponding to the amount of clothes ($W_d$), and the actual detected amount of circulation water ($Q_d$). For example, when $Q_0>Q_d$, clothes absorbs a large amount of water than anticipated and thus the detected amount of circulation water is small. This case signifies that clothes having a high water absorption rate are introduced in the washing machine. When $Q_0<Q_d$, this case signifies that clothes having a low water absorption rate are introduced to the washing machine. Furthermore, it is also possible to obtain properties of clothes, which are minutely classified in accordance with the difference ($\Delta Q$) between the anticipated amount of circulation water ($Q_0$) and the actually detected amount of circulation water ($Q_d$). Table 1 below shows an exemplary standard of determining three properties of clothes (S1, S2, and S3) based on an anticipated amount of circulation water ($Q_0$(1), $Q_0$(2)) and an actual amount of circulation water ($Q_d$) in both cases of a smaller amount ($LV_1$) of clothes and a larger amount ($LV_2$) of clothes, in which S1, S2, and S3 designate water absorption rates which are increased in this order.

TABLE 1

| Amount of clothes ($W_d$) | Anticipated amount of circulation water ($Q_0$) | $\Delta Q = Q_0 - Q_d$ | Properties of clothes |
|---|---|---|---|
| $LV_1$ (small amount) | $Q_0$ (1) | $a1 < \Delta Q < a2$ | S1 |
| | | $a2 < \Delta Q < a3$ | S2 |
| | | $a3 < \Delta Q < a4$ | S3 |
| $LV_2$ (large amount) | $Q_0$ (2) | $b1 < \Delta Q < b2$ | S1 |
| | | $b2 < \Delta Q < b3$ | S2 |
| | | $b3 < \Delta Q < b4$ | S3 |

A washing condition setting step S7 serves to set washing conditions according to the properties of clothes determined in step S6. Controller 10 may set various washing conditions such as washing time, driving pattern of the inner tub 150 and/or the pulsator 116, rinsing or dewatering time, dewatering speed, and additional water supply amounts according to the determined properties of clothes.

Thereafter, a washing is performed according to the washing conditions set in step S7 (S8), and a water discharge is operated after completion of the washing (S9). In the water discharge step S9, the water discharge pump 144 may be activated in conjunction with dewatering by high-speed rotation of the inner tub 150.

After completion of water discharge in step S9, an amount of wetted clothes may be detected (S10). Although the wetted clothes detecting step S10 is substantially identical to the clothes amount detecting step S1, both the operations are different from each other in that an amount of clothes is detected in the state of being wetted in step S10.

In a dewatering condition setting step S11, the controller 10 may set dewatering conditions such as a rotational speed of the inner tub 150 (RPM3 of FIG. 7) and a rotation time, according to the amount of wetted clothes detected in step S10. In this operation, the properties of clothes determined in step S6 may also be considered. Particularly, clothes having a low water absorption rate which are easily dewatered, for example, functional clothing such as nylon and polyester, underwear, seasonal clothing (T-shirts and half sleeved shirts), and the like can be sufficiently dewatered even if a dewatering speed or dewatering time is decreased, compared to clothes having a high water absorption rate, for example, general fabrics such as cotton trousers and blue jeans, winter clothing, bedding and the like. Accordingly, power consumption and dewatering time can be reduced by setting the maximum rotational speed for dewatering to be low or setting a dewatering time to be short in the case of clothes having a low water absorption rate.

Conversely, in the case of clothes having a high water absorption rate, dewatering performance can be improved by setting the maximum rotational speed for dewatering to be high or setting a dewatering time to be long.

In some embodiments, the wetted clothes amount detecting operation S10 may be omitted. In an operation S11, dewatering conditions may be set based on the amount of clothes detected in operation S1 and the properties of clothes obtained in operation S6.

As described above, the method of controlling a washing machine according to one embodiment of the present invention can detect properties of clothes and thus can perform washing appropriate to the properties of clothes.

Furthermore, the method of controlling a washing machine according to one embodiment of the present invention can estimate properties of clothes (particularly, water absorption rate of clothes) without performing water discharge.

Additionally, the method of controlling a washing machine according to one embodiment of the present invention can detect properties of clothes at an initial stage at which water supply is performed and thus can optimally perform respective subsequent procedures such as washing, rinsing, dewatering, and the like based on the detected properties of clothes.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A method of controlling a washing machine including an outer tub and an inner tube rotatably disposed in the outer tub to contain clothes, the method comprising:

(a) detecting an amount of clothes while the clothes are not submerged;

(b) supplying water between the outer tub and the inner tub such that the clothes are not wetted with water;

(c) discharging water from the outer tub to a circulation channel and introducing water into the inner tub through the circulation channel to wet the clothes with water;

(d) detecting fluctuation in water level in the outer tub during execution of step (c);

(e) discharging water that is not absorbed in the clothes but collected in the outer tub to the circulation channel such that a water level in the outer tub becomes zero while detecting a flow rate of the discharged water; and (f) determining an actual amount of circulation water discharged to the circulation channel based on the flow rate detected in (e) until a water level in the outer tub becomes zero and determining properties of the clothes based on the actual amount of circulation water and a predetermined anticipated amount of circulation water corresponding to the amount of clothes detected in step (a), wherein step (e) is performed after fluctuation of water level in the outer tub is regulated in a predetermined range, wherein step (c) comprises spraying water, transferred through the circulation channel, into the inner tub, and wherein step (c) comprises rotating the inner tub at a rotational speed during spraying of water into the inner tub such that the clothes adhere to an inner side wall of the inner tub.

2. The method according to claim 1, wherein discharging the water in step (c) or (e) is performed by activation of a circulation pump provided at the circulation channel.

3. The method according to claim 2, wherein the flow rate in step (e) is determined based on a rotational speed of the circulation pump.

4. The method according to claim 3, wherein the actual amount of circulation water is determined based on the flow rate determined in step (e) and an activation time of the circulation pump until a water level in the outer tub becomes zero during detection of the flow rate.

5. The method according to claim 4, further comprising detecting when a water level in the outer tub becomes zero based on variation of driving current of the circulation pump.

6. The method according to claim 1, further comprising setting dewatering conditions based on information of the properties of clothes determined in step (f).

7. The method according to claim 6, wherein, the information of the properties of clothes determined in step (f) includes a water absorption rate of clothes, as the water absorption rate is lower, a maximum rotational speed for dewatering is set to be lower.

8. The method according to claim 6, wherein, the information of the properties of clothes determined in step (f) includes a water absorption rate of clothes, as the water absorption rate is lower, a dewatering period of time is set to be shorter.

9. The method according to claim 6, wherein, the information of the properties of clothes determined in step (f) includes a water absorption rate of clothes, as the water absorption rate is higher, a maximum rotational speed for dewatering is set to be higher.

10. The method according to claim 6, wherein, the information of the properties of clothes determined in step (f) includes a water absorption rate of clothes, as the water absorption rate is high, a dewatering period of time is set to be longer.

11. The method according to claim 1, further comprising after step (f):

(g) discharging water from the outer tub; and (h) detecting an amount of the clothes after discharge of water from the outer tub, wherein dewatering conditions are set based on the amount of clothes detected in step (h) and information of the properties of clothes determined in step (f).

12. The method of claim 1, wherein the rotational speed of the inner tub is above the speed where the clothes adhere to an inner side wall of the inner tub.

13. The method of claim 1, wherein the rotational speed which causes the clothes to adhere to an inner side wall of the inner tub is based on the amount of dry clothes detected in step (a).

14. The method of claim 11, wherein one dewatering condition is a rotational speed of the inner tub.

15. The method of claim 11, wherein the rotational speed of the inner tub for dewatering is based on the amount of wet clothes detected in step (h).

16. The method of claim 15, wherein the rotational speed of the inner tub for dewatering is further based on the properties determined in step (f).

* * * * *